US011008196B2

(12) United States Patent
Quiles et al.

(10) Patent No.: US 11,008,196 B2
(45) Date of Patent: May 18, 2021

(54) BLOCKING DEVICE

(71) Applicant: Otis Elevator Company, Farmington, CT (US)

(72) Inventors: Juan Quiles, Rivasvaciamadrid (ES); Antonio De Miguel Urquijo, Madrid (ES); Gianluca Foschini, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 79 days.

(21) Appl. No.: 16/032,107

(22) Filed: Jul. 11, 2018

(65) Prior Publication Data

US 2019/0016559 A1 Jan. 17, 2019

(30) Foreign Application Priority Data

Jul. 12, 2017 (EP) ..... 17180926

(51) Int. Cl.

| | |
|---|---|
| ***E05B 65/00*** | (2006.01) |
| ***B66B 5/00*** | (2006.01) |
| ***B66B 13/24*** | (2006.01) |
| ***E05B 67/00*** | (2006.01) |

(52) U.S. Cl.

CPC ..... *B66B 5/005* (2013.01); *B66B 13/245* (2013.01); *E05B 65/00* (2013.01); *E05B 67/00* (2013.01)

(58) Field of Classification Search

CPC ..... B66B 5/005; B66B 13/245; E05C 19/18; E05B 65/00; E05B 67/00; F16B 13/04

USPC ..... 70/35, 232; 411/344, 348, 386, 940, 41; 403/408; 285/80

See application file for complete search history.

(56) References Cited

U.S. PATENT DOCUMENTS 481,458 A * 8/1892 Zell ..... E05B 17/002 70/35
575,032 A * 1/1897 Kimbrell ..... F16G 15/06 278/96
2,566,816 A * 9/1951 Work ..... F16L 55/132 220/210
2,609,723 A * 9/1952 Stubbs ..... F16B 13/0808 411/340

(Continued)

FOREIGN PATENT DOCUMENTS

CN 2448985 Y 9/2001
CN 1253367 C 4/2006

(Continued)

OTHER PUBLICATIONS

European Search Report for application EP 17180926.2, dated Jan. 31, 2018, 9 pages.

(Continued)

*Primary Examiner* — Suzanne L Barrett
(74) *Attorney, Agent, or Firm* — Cantor Colburn LLP

(57) ABSTRACT

A blocking device (2) for blocking access to an door unlocking device (118) of an elevator system (102) comprises: an outer element (4), which is introducible into an access opening (30) providing access to the door unlocking device (118); and an inner element (6), which is introducible into the outer element (4). The inner element (6) is configured for bringing the blocking device (2) into a fixing configuration, in which the outer element (4) is fixedly engaged with the access opening (30), by introducing the inner element (6) into the outer element (4).

10 Claims, 4 Drawing Sheets

(56) References Cited

U.S. PATENT DOCUMENTS 2,883,850 A * 4/1959 Falck ..... E05B 13/001 70/431
3,130,571 A * 4/1964 Neumann ..... A63B 37/0001 70/58
3,248,994 A * 5/1966 Mortensen ..... F16B 13/0808 411/344
3,534,650 A * 10/1970 Kubokawa ..... F16B 19/109 411/344
3,669,481 A * 6/1972 Bergmann ..... E05B 63/127 292/49
3,707,898 A * 1/1973 Holly ..... F16B 13/0808 411/344
3,812,810 A * 5/1974 Moeller ..... B63B 13/00 114/197
3,950,971 A * 4/1976 Karls ..... B65D 55/14 70/164
4,002,186 A * 1/1977 Fink ..... F16L 29/04 137/614.03
4,049,313 A * 9/1977 Lundberg ..... E05B 67/365 292/307 R
4,553,889 A * 11/1985 Le Dantec ..... F16B 13/04 405/259.1
4,655,657 A * 4/1987 Duran ..... F16B 21/10 411/21
5,066,049 A * 11/1991 Staples ..... F16L 35/00 285/315
5,163,795 A * 11/1992 Benoit ..... F16B 19/1081 411/41
5,186,636 A * 2/1993 Boyer ..... H01R 13/60 439/133
5,315,849 A * 5/1994 Georgopoulos .... E05B 65/0089 70/159
5,378,030 A * 1/1995 Georgopoulos .... E05B 65/0089 292/256.6
5,531,551 A * 7/1996 Bowers ..... F16B 5/04 24/607
6,419,258 B1 * 7/2002 Grote ..... B60D 1/06 280/507
6,883,546 B1 * 4/2005 Kobylinski ..... F16L 55/1141 138/89
7,097,001 B2 8/2006 Martin
7,530,775 B2 * 5/2009 Jaconelli ..... B60R 21/213 411/302
7,954,606 B2 6/2011 Tinone et al.
8,313,123 B1 * 11/2012 Hinkle ..... F16L 55/1157 138/89
8,348,568 B2 * 1/2013 Murakami ..... H05K 7/1488 411/44
9,630,804 B2 4/2017 Hovi et al.
10,267,349 B2 * 4/2019 Apostolopoulos ..... F16B 35/06
10,385,909 B2 * 8/2019 Kim ..... F16B 39/04
10,472,845 B2 * 11/2019 Stevens ..... H01Q 1/12
2003/0126721 A1 7/2003 Panek et al.
2004/0173415 A1 * 9/2004 Kocher ..... B66B 5/005 187/316
2018/0065830 A1 * 3/2018 Duchamp ..... B66B 5/005

FOREIGN PATENT DOCUMENTS

CN 202227811 U 5/2012
CN 102595969 A 7/2012
CN 104495579 A 4/2015
CN 103917471 B 6/2016
EP 1471028 B1 2/2007
EP 1863733 B1 12/2008
EP 1882666 B1 10/2013
EP 1845053 B1 4/2015
EP 2516307 B1 4/2015
EP 3056460 A1 8/2016
EP 3336039 A1 * 6/2018 ..... B66B 13/165
FR 1538579 A * 9/1968 ..... E05B 65/00
FR 2724197 A1 * 3/1996 ..... E05B 13/001
JP 2014144838 A 8/2014
WO 2016027118 A1 2/2016
WO 2016091777 A1 6/2016
WO 2016092337 A1 6/2016
WO 2016207683 A1 12/2016
WO 2017009678 A1 1/2017

OTHER PUBLICATIONS

Ultimate Security Devices, "Tri-Lok plug lock for elevator hoistway door safety with key and fob", available at: https://www.ultimatesecuritydevices.com/Tri-Lok-plug-lock-for-elevator-hoistway-door-safety-with-key-and-fob_p_1102.html, accessed Jul. 6, 2018, 7 pages.
Chinese Office Action for Application No. 201810763220.8; dated Apr. 1, 2020; 10 Pages.

* cited by examiner

BLOCKING DEVICE

The invention relates to a blocking device, in particular to a blocking device for blocking a door unlocking device of an elevator system.

Elevator systems may be equipped with at least one door unlocking device, which allows an authorized person, in particular a mechanic, to manually unlock a door, e.g., a landing door, providing access to the hoistway for maintenance and/or repair. In some cases the door unlocking device is provided with a safety switch. The safety switch works as a detection device for detecting any intrusion into the hoistway in order to prevent risks to a mechanic while being in the hoistway.

Safety requirements include that the door unlocking device and in particular the safety switch have to be locked and protected so that they cannot be reset by another person while a person, in particular a mechanic, is within the hoistway. In order to fulfill this requirement, a locking device, which is configured for blocking/locking the door unlocking device, may be supplied with the elevator, or carried by an elevator service person as a personal tool.

It therefore is desirable to provide an improved blocking device, which may be produced at low costs and which is handled easily.

According to an exemplary embodiment of the invention, a blocking device comprises: an outer element, which is introducable into an access opening providing access to the door unlocking device, and an inner element, which is introducable into the outer element. The blocking device is configured to be brought into a fixing configuration in which the outer element is fixedly engaged with the access opening by introducing/inserting the inner element into the outer element. The inner element in particular is configured for bringing the blocking device into the fixing configuration by engaging the inner element with the outer element.

Exemplary embodiments of the invention include an elevator system comprising a door unlocking device, which is configured for unlocking a door of the elevator system, wherein the door unlocking device is accessible via an access opening; and a blocking device according to an exemplary embodiment of the invention.

Exemplary embodiments of the invention further include using a blocking device according to an exemplary embodiment of the invention for blocking a door unlocking device of an elevator system, in particular by introducing the outer element of the blocking device into an access opening providing access to the door unlocking device.

Exemplary embodiments of the invention in particular include a method of blocking a door unlocking device of an elevator system according to an exemplary embodiment of the invention, wherein the method includes the steps of introducing the inner element of the blocking device into the outer element; introducing the outer element of the blocking device into the access opening; tightening the inner element for fixing the outer element within the access opening. The inner element of the blocking device may be introduced into the outer element of the blocking device before or after the outer element is introduced into the access opening.

Exemplary embodiments of the invention provide a compact and convenient blocking device, which is easy to use. Due to its compact design, a blocking device according to an exemplary embodiment of the invention may be kept within the elevator system or carried by the field mechanics in their toolkits. A blocking device according to an exemplary embodiment has a low weight. Due to its low complexity it may be produced at low costs.

A number of optional features are set out in the following. These features may be realized in particular embodiments, alone or in combination with any of the other features.

The outer and inner elements may be configured such that the inner element is completely enclosed by the outer element when introduced into the outer element. This results in a compact design and prevents the inner element from being accidentally loosened and/or removed.

The outer element may comprise a spreadable fixing portion which may be spreaded by introducing the inner element into the outer element. By spreading the fixing portion the outer element may be securely and conveniently engaged and fixed within the access opening.

At least one of the inner and outer elements may comprise a tapered and/or curved surface which is configured to cause the spreadable fixing portion to spread when the inner element is introduced into the outer element. A tapered or curved surface provides a reliable mechanism for spreading the fixing portion. Such a mechanism may be produced at low costs.

The spreadable fixing portion may comprise a plurality of engagement elements. Each of the engagement elements may be attached elastically to or formed integrally with the outer element. In such a configuration, the engagement elements may be spreaded, i.e. forced apart from each other, by introducing the inner element into the outer element in order to engage the outer element within the access opening.

The inner element and/or the outer element may have a basically cylindrical shape. Inner and outer elements having a basically cylindrical shape are easy to produce and allow for a convenient handling. In an alternative embodiment, only a portion of the outer element may have a curved/cylindrical shape; whereas other portions have a linear shape.

The outer element may comprise an inner thread and the inner element may comprise a matching outer thread. Matching threads allow the inner element to be threaded into the outer element. Threading the inner element into the outer element provides a convenient way of engaging the inner and outer elements with each other. It further allows for securely engaging the outer element within the access opening by applying only a comparatively small force to the inner element.

The inner element may comprise an engagement portion, which is configured to engage with a matching tool or key for moving the inner element with respect to the outer element. This allows engaging and/or disengaging the inner element conveniently using a matching tool or key. It further prevents an unauthorized person, which is not in possession of the right tool or key, from disengaging and/or removing the inner portion.

The engagement portion may be a triangular engagement portion which is configured for matching with a corresponding triangular key. A triangular key is commonly used for elevator maintenance.

The blocking device may comprise a holding portion or a holding element which is configured for preventing the inner element from being completely separated from the outer element. In consequence, the inner and outer elements are kept together, and the inner element is prevented from getting lost.

The blocking device may comprise a locking device, which is configured for locking the inner element in the fixing position within the outer element in order to prevent an unauthorized removal of the blocking device. The locking device in particular may comprise a lock, which may be opened only with a matching key. Alternatively, the lock may be a combination lock, which may be opened (only) by entering a correct code.

The locking device may be a padlock and at least one of the inner portion and the outer element may comprise at least one hole ("locking opening") which is configured for receiving a bar or bolt of the padlock for locking the inner element. This allows to lock the blocking device using a usual padlock.

The door unlocking device may be provided with a safety switch. The safety switch in particular may be a hoistway access detection switch, which is configured for monitoring access to a hoistway of the elevator system. The safety switch may be arranged at a landing door, at an elevator car, at a machine room and/or within a pit of the elevator system. Blocking the door unlocking device by means of a blocking device according to an exemplary embodiment of the invention also blocks the safety switch. This allows a mechanic to safely enter the hoistway, in particular a pit, of the elevator system for maintenance and/or repair.

In the following, an exemplary embodiment of the invention is described in more detail with reference to the enclosed figures.

FIG. 1 schematically depicts an elevator system in which a blocking device according to an exemplary embodiment of the invention may be employed;

Figure 1:
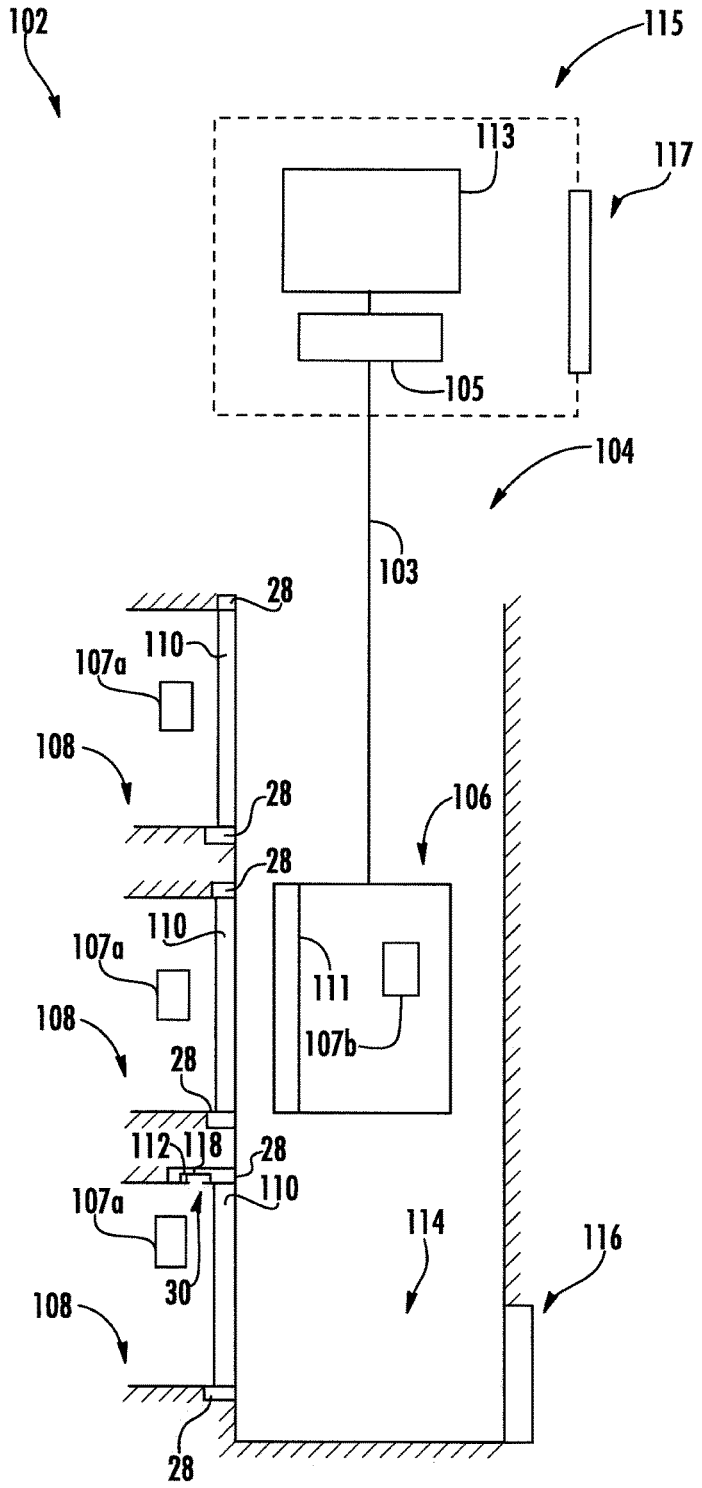

FIG. 1 schematically depicts an elevator system 102 in which a blocking device 2 according to an exemplary embodiment may be employed.

The elevator system 102 comprises an elevator car 106 which is movably suspended within a hoistway 104 extending between a plurality of landings 108, which are located on different floors. A pit 114 is provided at the bottom of the hoistway 104.

The elevator car 106 is movably suspended by means of a tension member 103. The tension member 103, for example a rope or belt, is connected to an elevator drive unit 105, which is configured for driving the tension member 103 in order to move the elevator car 106 along the height of the hoistway 104 between the plurality of landings 108.

Each landing 108 is provided with a landing door 110 mounted to a landing door frame. The elevator car 106 is provided with a corresponding elevator car door 111 for allowing passengers to transfer between a landing 108 and the interior of the elevator car 106 when the elevator car 106 is positioned at the respective landing 108.

The exemplary embodiment shown in FIG. 1 uses a 1:1 roping for suspending the elevator car 106. The skilled person, however, easily understands that the type of the roping is not essential for the invention and that different kinds of roping, e.g. a 2:1 roping, may be used as well. The elevator system 102 may use a counterweight (not shown) or not. The elevator drive unit 105 may be any form of drive used in the art, e.g. a traction drive, a hydraulic drive or a linear drive. The elevator system 102 may have a machine room 115 or may be a machine room-less elevator system. The elevator system 102 may use a tension member 103, as it is shown in FIG. 1, or it may be an elevator system without a tension member 103, comprising e.g. a hydraulic drive or a linear drive (not shown).

The elevator drive unit 105 is controlled by an elevator control unit 113 for moving the elevator car 106 along the hoistway 104 between the different landings 108.

Input to the elevator control unit 13 may be provided via landing control panels 107*a*, which are provided on each landing 108 close to the landing doors 110, and/or via a car operation panel 107*b* provided inside the elevator car 106.

The landing control panels 107*a* and the car operation panel 107*b* may be connected to the elevator control unit 113 by means of electrical lines, which are not shown in FIG. 1, in particular by an electric bus, or by means of wireless data connections.

A door unlocking device 118 which allows a mechanic to manually unlock a landing door 110 for entering the hoistway 14 for maintenance and/or repair. The door unlocking device 118 is provided with a safety switch 112. The safety switch 112 is activated when the door unlocking device 118 is activated for unlocking the landing door 110. The skilled person will understand that alternatively or additionally door unlocking devices 118 including safety switches 112 may be provided at other landing doors 110 and/or at other doors 116, 117 respectively providing access to the machine room 115 and/or to the pit 114 of the hoistway 14 as well.

The door unlocking device 118 is accessible via an access opening 30 formed in the landing door frame 28. In some embodiments the safety switch 112 is activated in order to allow operating the elevator in a maintenance mode after a person has entered the hoistway 104 via the landing door 110 in a situation in which the elevator car 106 is not positioned at the lowest landing 108.

In a further embodiment the safety switch 112 is activated for stopping operation of the elevator system 102 when the landing door is opened 108 in a situation in which the elevator car 106 is positioned at another landing. After having entered the hoistway 104, the mechanic may start a maintenance mode of operation while the safety switch 112 is activated. The activated safety switch 112 prevents the elevator system 102 from operating in a normal mode of operation.

As mentioned before, the door unlocking device 118 and the safety switch 112 have to be blocked so that the safety switch 112 cannot be reset while a person (mechanic) is present within the hoistway 114.

Figure 2:
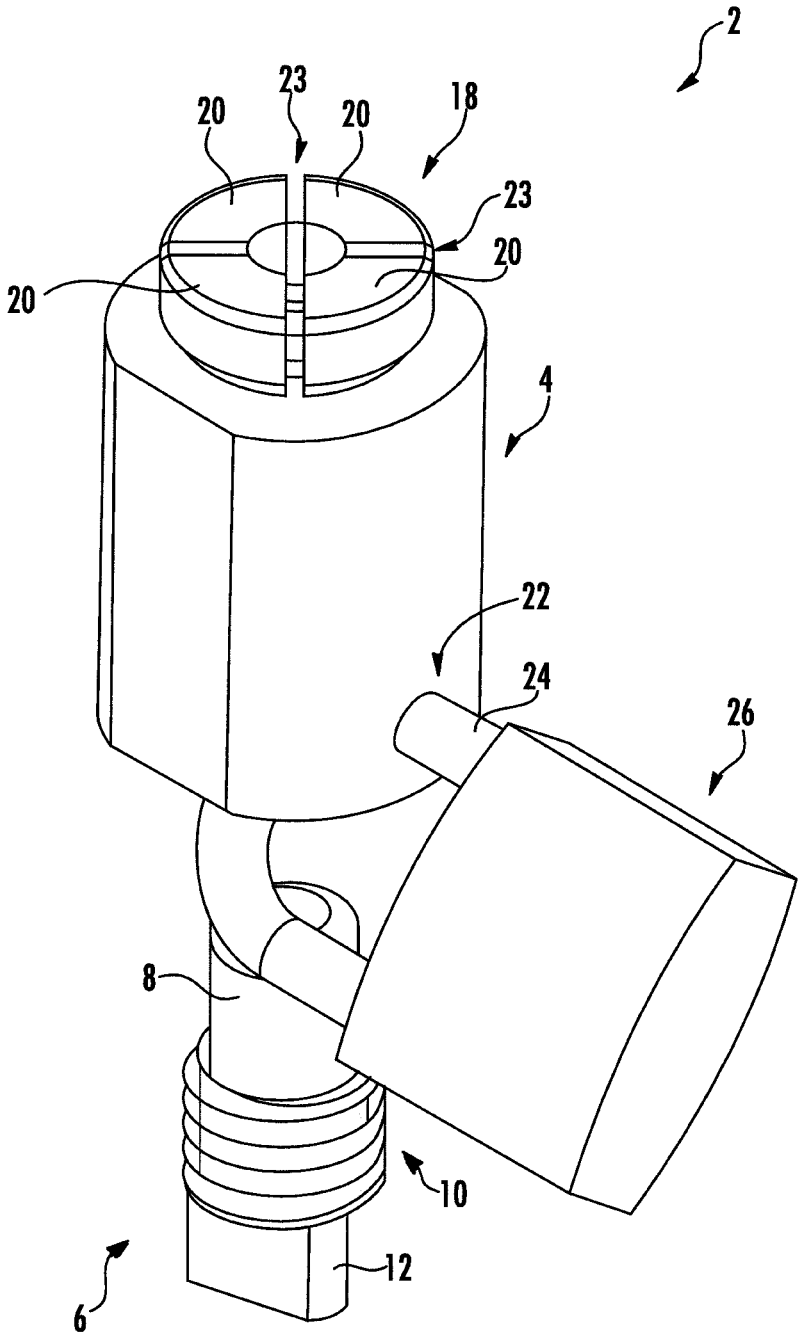
FIG. 2 shows a perspective view of a blocking device according to an embodiment.
Figure 3:
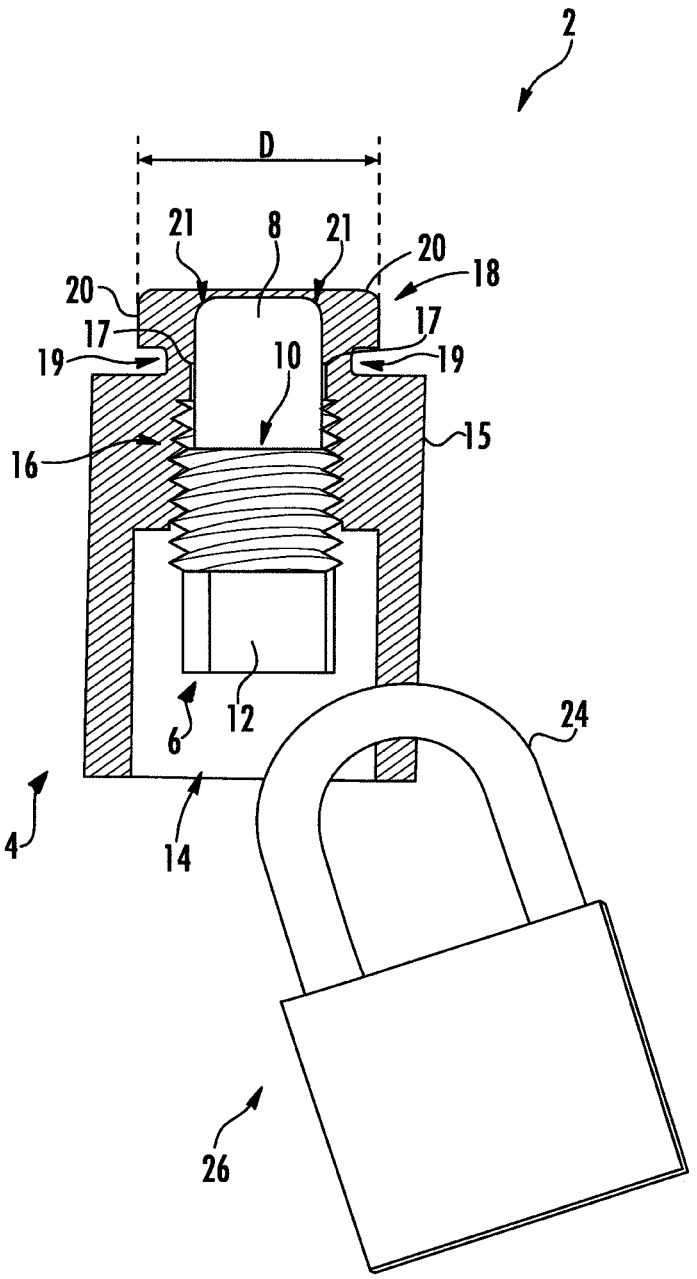
FIG. 3 shows a cross-sectional view of the blocking device shown in FIG. 2.

FIG. 2 shows a perspective view of a blocking device 2 according to an embodiment of the invention, and FIG. 3 a sectional view of said blocking device 2.

The blocking device 2 comprises an outer element (outer body) 4 and an inner element (inner body) 6. In FIG. 2 the inner element is depicted outside (below) the outer element 4, in FIG. 3 the inner element is depicted inside the outer element 4.

The inner element 6 comprises a first portion 8 having a basically cylindrical shape, which is shown as an upper portion 8 in FIGS. 2 and 3. The edges 21 at the outer (upper) end of the first portion 8 are slightly curved. In an alternative embodiment, which is not shown in the Figures, the edges 21 at the outer (upper) end of the first portion 8 may be tapered or slanted.

The inner element 6 further comprises a second/intermediate portion 10, which is arranged next to the first/upper portion 8 and which is provided with an outer thread.

Next to the second/intermediate portion 10 opposite to the first portion 8, there is a third portion 12, which is depicted as a lower portion 12 in FIGS. 2 and 3, respectively. The third portion 12 is an engagement portion 12 which is configured for engagement with an appropriate engagement tool (not shown), such as a wrench or key. In the embodiment shown in FIGS. 2 and 3, the engagement portion 12 has a triangular cross-section for engagement with a triangular key, as it is commonly used for elevator maintenance. In alternative embodiments, which are not explicitly shown in the figures, the engagement portion 12 portion may have a quadratic or hexagonal cross-section for engagement with a correspondingly shaped tool, such as a common wrench or spanner.

A hollow space 14 is formed within the outer element 4. In the orientation shown in FIGS. 2 and 3, the hollow space 14 is formed at and open to the bottom of the outer element 4. This allows the inner element 6 to be inserted into the hollow space 14 of the outer element 4 from the bottom.

At the side of the hollow space 14, which is opposite to the open end, a bore 16 is formed in a portion 15 of the outer element 4, which is formed next to the hollow space 14. The circumferential outer wall of the bore 16 is provided with an inner thread. The inner thread matches the outer thread formed at the outer circumference of the second portion 10 of the inner element 6. The combination of the inner and outer threads allows the inner element 6 to be screwed into the outer element 4. A tool or key (not shown), which is in engagement with the engagement portion (third portion) 12 of the inner element 6, may be used for screwing the inner element 6 into the outer element 4.

At the end opposite to the opening, i.e. at the end which is shown at the top of FIGS. 2 and 3 the outer element 4 is provided with a spreading portion 18.

The spreading portion 18 has a circular cross-section (see FIG. 2) and comprises a plurality, for example four, engagement elements 20. The engagement elements 20 are separated from each other by slits 23. In the embodiment shown in FIG. 2, the slits 23 extend radially between adjacent engagement elements 20 forming a cross centered at the center of the spreading portion 18.

The engagement elements 20 are elastically connected to the second portion 10 of the outer element 4 by means of connection portions 19 respectively extending between an associated engagement element 20 and the outer element 4. The bore 16 extends through the center of the spreading portion 18. The engagement elements 20 and the connection portions 19 may be formed integrally with each other. The connection portions 19 may be formed integrally with the outer element 4.

In the orientation shown in FIGS. 2 and 3, the inner element 6 moves upwards, when it is screwed into the outer element 4. The first (upper) portion 8 of the inner element 6 in particular moves into the space between the engagement elements 20 and spreads the engagement elements 20 outwards increasing the diameter of the spreading portion 18.

In case the spreading portion 18 has been inserted into an access opening 30 (see FIG. 4) having a diameter which is only slightly larger than the diameter D of the spreading portion (see FIG. 3) in its relaxed state, i.e. in a state in which it is not spread, the spreading of the spreading portion 18 will cause the outer element 4 to engage with said access opening 30 fixing the blocking device 2 within said access opening 30.

The blocking device 2 may be removed from the access opening 30 by untightening the inner element 6, which causes the engagement elements 20 to unspread. In consequence, the diameter of the spreading portion 18 is reduced, which allows the outer element 4 to be removed from the access opening 30.

The blocking device 2 comprises a holding portion 17 provided at the outer element 4 and/or a holding element provided at the inner element 6. The holding portion 17 and/or the holding element are configured for preventing the inner element 6 from being completely separated from the outer element 4. As a result, the outer and inner elements 4, 6 are kept together and it is avoided that the inner element 6 gets lost.

At least one hole ("locking opening") 22 is provided in a circumferential sidewall of the hollow space 14. A bar/bolt 24 of a padlock 26 may be passed through said hole 22, as it is shown in FIGS. 2 and 3. As a result, the access to the engagement portion 12 of the inner element 6 may blocked by means of the padlock 26.

In case the inner element 6 is blocked by the padlock 26, the padlock 26 needs to be unlocked and removed for allowing access to the engagement portion 12 for releasing the inner portion 6 and reducing the diameter of the spreading portion 18. This is necessary for being able to remove the locking device 2 from the access opening 30 for providing access to the door unlocking device 118.

The padlock 26, when locked, prevents ("blocks") unauthorized access to the inner element 6 and thus prevents an unauthorized removal of the blocking device 2.

The skilled person will understand that alternative locking mechanisms may be used instead of the padlock 26.

Figure 4:
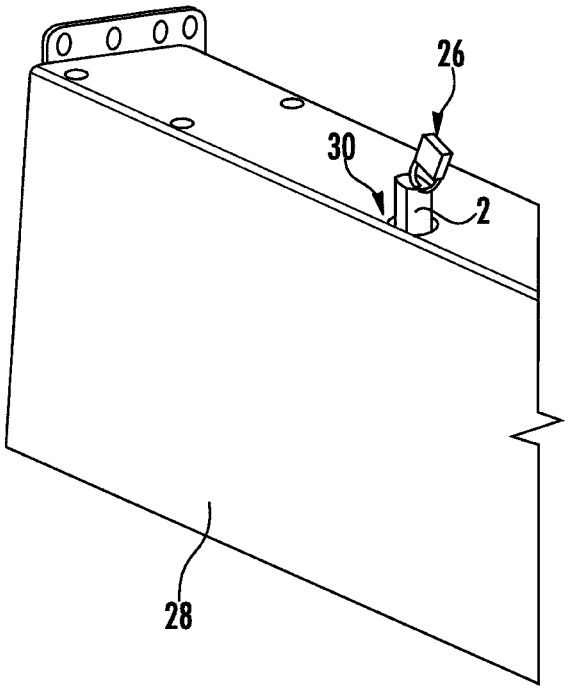
FIG. 4 shows an enlarged sectional view of a portion of a landing door frame with a blocking device according to an exemplary embodiment.

FIG. 4 shows an enlarged sectional view of a portion of the landing door frame 28 comprising the access opening 30 providing access to the door unlocking device 118 with the safety switch 112. The door unlocking device 118 and the safety switch 112 are not visible in FIG. 4 as they are covered by the landing door frame 28.

A blocking device 2 according to an exemplary embodiment of the invention is introduced into said access opening 30 for preventing access to the door unlocking device 118. The blocking device 2 is locked by means of a padlock 26 preventing an unauthorized removal of the blocking device 2. Only a person (mechanic) in possession of a matching key is able to unlock and remove the padlock 26, to release the inner element 6 and to remove the outer element 4 from the access opening 30 in order to access the door unlocking device 118 via the access opening 30 in order to switch the elevator system 102 from a maintenance mode back to a mode of normal operation.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention includes all embodiments falling within the scope of the dependent claims.

REFERENCES

2 blocking device
4 outer element
6 inner element
8 first/upper portion of the inner element
10 second/intermediate portion of the inner element
12 third/lower/engagement portion of the inner element
14 hollow space
15 portion of the outer element next to the hollow space
16 bore
17 holding portion
18 spreading portion
19 connection portion

20 spreading element
21 edge
22 hole
23 slit
24 bar/bolt
26 padlock
28 landing door frame
30 access opening
102 elevator system
103 tension member
104 hoistway
106 elevator car
107*a* landing control panels
107*b* car operation panel
108 landing
110 landing door
111 elevator car door
112 safety switch
113 elevator control unit
114 pit
115 machine room
116 door providing access to the pit
117 door providing access to the machine room
118 door unlocking device
D diameter of the spreading portion

What is claimed is:

1. A blocking device for blocking access to a door unlocking device of an elevator system, wherein the door unlocking device is configured for unlocking a door of the elevator system, and wherein the blocking device comprises:

an outer element, which is introducible into an access opening which provides access to the door unlocking device;

an inner element, which is introducible into the outer element and which is configured for bringing the blocking device into a fixing configuration, in which the outer element is fixedly engaged with the access opening, by introducing the inner element into the outer element;

a locking device separate from the inner element, the locking device configured for locking the inner element in a fixing position within the outer element;

wherein the outer element comprises an inner thread on an inner cylindrical surface thereof and the inner element comprises a matching outer thread on an outer cylindrical surface thereof, the inner thread and outer thread allowing the inner element to be threaded into the outer element;

wherein the outer and inner elements are configured such that the inner element is completely enclosed by the outer element when introduced into the outer element.

2. The blocking device according to claim 1, wherein the outer element comprises a spreadable fixing portion which is spreadable by introducing the inner element into the outer element, wherein the spreadable fixing portion comprises a plurality of engagement elements which are elastically attached to or formed integrally with the outer element.

3. The blocking device according to claim 2, wherein at least one of the outer and inner elements comprises a tapered or curved surface which causes the spreadable fixing portion to spread when the inner element is introduced into the outer element.

4. The blocking device according to claim 1, wherein at least one of the outer and inner elements has a basically cylindrical shape.

5. The blocking device according to claim 1, wherein the inner element comprises an engagement portion configured for engaging with a matching tool or key.

6. The blocking device according to claim 1, further comprising a holding portion or a holding element which is configured for preventing the inner element from being separated from the outer element.

7. The blocking device according to claim 1 wherein the locking device comprises a padlock and at least one of the outer and inner elements comprises at least one hole which is configured for receiving a bar or bolt of the padlock for locking the inner element.

8. An elevator system comprising:

a door unlocking device, which is configured for unlocking a door of the elevator system, and which is accessible via an access opening; and a blocking device according to claim 1, wherein the door unlocking device is arranged at a landing door, at an elevator car, at a machine room and/or within a pit of the elevator system.

9. A method of blocking a door unlocking device of an elevator system according to claim 8, wherein the method includes:

introducing the inner element of the blocking device into the outer element of the blocking device;

introducing the outer element of the blocking device into the access opening; and tightening the inner element for fixing the outer element within the access opening;

attaching the locking device to the blocking device such as to lock the inner element in the fixing position in which the inner element fixes the outer element within the access opening.

10. A method of blocking a door unlocking device of an elevator system according to claim 8, wherein the method includes:

introducing the outer element of the blocking device into the access opening;

introducing the inner element of the blocking device into the outer element of the blocking device; and tightening the inner element for fixing the outer element within the access opening;

attaching the locking device to the blocking device such as to lock the inner element in the fixing position in which the inner element fixes the outer element within the access opening.

* * * * *